US010676956B1

(12) United States Patent
Kalvani

(10) Patent No.: US 10,676,956 B1
(45) Date of Patent: Jun. 9, 2020

(54) MODULAR TENT

(71) Applicant: Kalvani IP Holdings, LLC, South Barrington, IL (US)

(72) Inventor: Bimal A. Kalvani, South Barrington, IL (US)

(73) Assignee: Kalvani IP Holdings, LLC, South Barrington, IL (US)

( * ) Notice: Subject to any disclaimer, the term of this patent is extended or adjusted under 35 U.S.C. 154(b) by 0 days.

(21) Appl. No.: 15/719,140

(22) Filed: Sep. 28, 2017

Related U.S. Application Data

(63) Continuation of application No. 14/992,943, filed on Jan. 11, 2016, now Pat. No. 9,777,508.

(51) Int. Cl.

| | |
|---|---|
| ***E04H 15/56*** | (2006.01) |
| ***E04H 15/54*** | (2006.01) |
| ***E04H 15/42*** | (2006.01) |
| ***E04H 15/34*** | (2006.01) |

(52) U.S. Cl.
CPC ..... *E04H 15/56* (2013.01); *E04H 15/34* (2013.01); *E04H 15/425* (2013.01); *E04H 15/54* (2013.01)

(58) Field of Classification Search
CPC ..... E04H 15/54; E04H 15/64; E04H 15/36; E04H 15/34; E04H 15/56; E04H 15/42; E04H 15/18; E04H 15/32
USPC ..... 135/124, 136–137, 148, 156, 115, 116, 135/905–906, 119, 120.1
See application file for complete search history.

(56) References Cited

U.S. PATENT DOCUMENTS

| | | | | |
|---|---|---|---|---|
| 2,608,198 A * | 8/1952 | Goodman | B60J 11/00 | 135/125 |
| 3,586,013 A * | 6/1971 | Gladden | E04H 15/32 | 135/116 |
| 4,519,410 A * | 5/1985 | Kubacki | E04H 15/54 | 135/93 |
| 4,709,718 A * | 12/1987 | Nichols | E04H 15/40 | 135/115 |
| 5,031,652 A | 7/1991 | Lester | | |
| 5,067,505 A | 11/1991 | Cantwell | | |

(Continued)

FOREIGN PATENT DOCUMENTS

| | | |
|---|---|---|
| CN | 203308177 | 11/2013 |
| CN | 204126362 | 1/2015 |

(Continued)

OTHER PUBLICATIONS

International Application No. PCT/US2016/018092, International Search Report and Written Opinion dated Apr. 19, 2016.

(Continued)

*Primary Examiner* — Winnie Yip
(74) *Attorney, Agent, or Firm* — Sheppard Mullin Richter & Hampton LLP

(57) ABSTRACT

Systems, methods, and apparatus include a modular tent comprising an upper tent portion having a first base surface area, wherein the upper tent portion does not include a floor surface; and a base extension that includes a floor surface having a second base surface area, the second base surface area being larger than the first base surface area, wherein the base extension is removably secured to the upper tent portion, wherein the base extension, when secured to the upper tent portion, results in a base surface area of the modular tent increasing to the second base surface area.

13 Claims, 8 Drawing Sheets

(56) References Cited

U.S. PATENT DOCUMENTS

| | | | | |
|---|---|---|---|---|
| 5,217,034 | A | 6/1993 | Yih | |
| 5,365,961 | A | 11/1994 | Bamber | |
| 5,699,820 | A | 12/1997 | Evans | |
| 5,769,106 | A | 6/1998 | Achuff | |
| 5,853,016 | A | 12/1998 | Cowan | |
| 6,167,898 | B1 | 1/2001 | Larga | |
| 6,216,715 | B1 | 4/2001 | Howe | |
| 6,273,114 | B1 | 8/2001 | Schafer | |
| 6,351,851 | B1 | 3/2002 | Yardan | |
| 7,222,635 | B2 * | 5/2007 | Cantwell | E04H 15/32 135/115 |
| 7,284,562 | B2 * | 10/2007 | Hardee | E04H 15/32 135/115 |
| 7,766,024 | B2 | 8/2010 | Rottmann | |
| 7,770,590 | B2 | 8/2010 | Serden | |
| 7,789,098 | B2 * | 9/2010 | Livacich | E04H 15/001 135/115 |
| 7,874,304 | B2 | 1/2011 | Ostrowski | |
| D652,885 | S | 1/2012 | Frey | |
| 8,555,910 | B2 | 10/2013 | Webster | |
| 8,991,667 | B2 | 3/2015 | Perez | |
| 9,631,395 | B1 * | 4/2017 | Todorov | E04H 15/54 |
| 9,976,318 | B2 * | 5/2018 | Lynch | E04H 15/40 |
| 2003/0106578 | A1 * | 6/2003 | Cornist | E04H 15/324 135/137 |
| 2005/0000555 | A1 * | 1/2005 | Besse | E04H 15/14 135/117 |
| 2006/0021643 | A1 | 2/2006 | Brensinger | |
| 2007/0272289 | A1 * | 11/2007 | Cooper | E04H 15/56 135/116 |
| 2009/0071522 | A1 * | 3/2009 | Seo | B29C 65/5042 135/116 |
| 2010/0170549 | A1 | 7/2010 | Bell | |
| 2016/0060897 | A1 * | 3/2016 | Baoqing | E04H 15/60 135/146 |

FOREIGN PATENT DOCUMENTS

| | | |
|---|---|---|
| CN | 204826864 | 12/2015 |
| CN | 205591640 | 9/2016 |
| DE | 3332169 | 3/1985 |
| FR | 2511234 | 2/1983 |
| FR | 2707686 | 1/1995 |
| GB | 2258666 | 2/1993 |
| JP | H10121784 | 5/1998 |
| JP | 2002227455 | 8/2002 |
| JP | 2002242487 | 8/2002 |
| TW | 201337079 | 9/2013 |
| WO | 2014076384 | 5/2014 |

OTHER PUBLICATIONS

Hilleberg the Tentmaker, "Atlas," product description webpage, http://us.hilleberg.com/EN/tent/blue-label-tents/atlas, Apr. 2013.

Hilleberg the Tentmaker, "Atlas: Pitching & Use Instructions," http://docs.hilleberg.net/pitching/H06-Instructions-Atlas-CompiledWeb-042213.pdf, Apr. 2013.

* cited by examiner

MODULAR TENT

CROSS-REFERENCE TO RELATED APPLICATIONS

This application is a continuation of U.S. patent application Ser. No. 14/992,943, filed on Jan. 11, 2016 and entitled "MODULAR TENT", which is incorporated herein by reference in its entirety.

FIELD OF THE INVENTION

The present technology relates to the field of camping equipment. More particularly, the present technology relates to modular tents.

BACKGROUND

The use of tents is a common and well-known way to provide campers (car campers, hikers/backpackers, mountaineers, hunters, military etc.) with temporary shelter and protection from the elements. Tents generally include a structural component, such as tent poles, and an enclosure supported by the structural component. It is generally desirable for a tent to be collapsible into a portable package so that the tent can be easily transported. Campers can purchase tents of varying attributes—sizes (e.g., maximum number of occupants), materials (engineered polymer fabrics, cotton canvas, mesh, aluminum, fiber glass etc.), shapes (domed, hexagonal, elliptical, pyramid, and other geometric design combinations) and quality (summer, 3 seasons, 4 seasons, car camping etc.) to suit their needs. Campers sometimes own multiple tents having such varying attributes, so that an appropriate tent can be selected based on the needs of a particular camping trip.

SUMMARY

The present disclosure may be embodied in a modular tent comprising an upper tent portion defining a first base surface area, wherein the upper tent portion does not include a floor surface; and a base extension that includes a floor surface having a second base surface area, the second base surface area being larger than the first base surface area, wherein the base extension is removably secured to the upper tent portion, wherein the base extension, when secured to the upper tent portion, results in a base surface area of the modular tent increasing to the second base surface area.

In an embodiment, the upper tent portion comprises a door and the base extension comprises a door extension.

In an embodiment, the door extension lowers an entryway height of the modular tent.

In an embodiment, the door extension is removably secured to the door.

In an embodiment, the base extension is removably secured to the upper tent portion using zip fastener.

In an embodiment, the modular tent further comprises one or more tent poles. The tent poles can be adjustable in length.

In an embodiment, the modular tent further comprises a rainfly having one or more adjustable dimensions.

In an embodiment, the base extension is removably secured to the upper tent portion using at least one of: a zip fastener, a hook and loop fastener, a press-in fastener, or a detachable slider.

The present disclosure may also be embodied in an apparatus comprising a base extension that includes a floor surface, the base extension being configured to be removably secured to an upper tent portion to increase a base surface area defined by the upper tent portion, wherein the upper tent portion does not include a floor surface; and a fastener for securing the base extension to the upper tent portion.

In an embodiment, the base extension comprises a door extension for extending an entryway of the upper tent portion.

In an embodiment, the door extension is configured to be removably secured to a door on the upper tent portion.

In an embodiment, the fastener comprises at least one of: a zip fastener, a hook and loop fastener, a press-in fastener, or a detachable slider.

The present disclosure can also be embodied in a method comprising: deploying a modular tent having an upper tent portion, wherein the upper tent portion does not include a floor surface; and securing a removable first base extension that includes a floor surface to the upper tent portion of the modular tent, the first base extension having a first base surface area that is different from an existing base surface area defined by the upper tent portion.

In an embodiment, the method further comprises: removing the removable first base extension from the upper portion of the modular tent; and securing a second base extension that includes a floor surface to the upper tent portion of the modular tent, the second base extension having a second base surface area that is greater than the first base surface area.

In an embodiment, the upper tent portion comprises a door, and the second base extension comprises a door extension.

In an embodiment, the first base extension does not comprise a door extension.

In an embodiment, when the second base extension is secured to the upper tent portion, the door extension is removably secured to the door.

In an embodiment, the door extension lowers an entryway height of the modular tent.

In an embodiment, the method further comprises adjusting a length of a support pole based on the first base extension; and securing the support pole to the upper tent portion.

In an embodiment, the method further comprises adjusting a size of a rainfly based on the first base extension, and securing the rainfly to the modular tent.

It should be appreciated that many other features, applications, embodiments, and/or variations of the disclosed technology will be apparent from the accompanying drawings and from the following detailed description. Additional and/or alternative implementations of the structures, systems, and methods described herein can be employed without departing from the principles of the disclosed technology.

Figure 1:
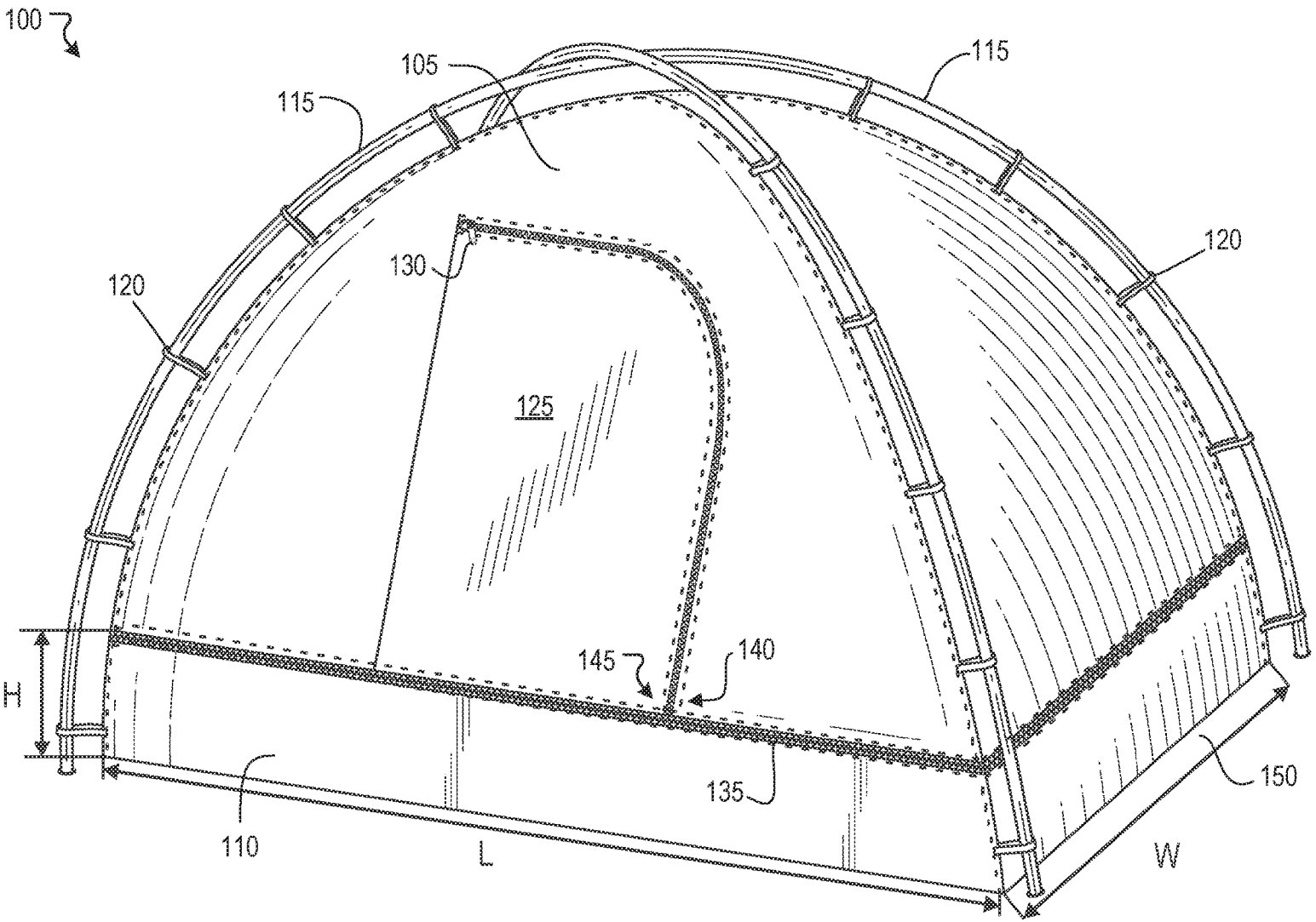
FIG. 1 provides a perspective view of a modular tent having a first, smaller base extension, according to an embodiment of the present disclosure.

The figures depict various embodiments of the disclosed technology for purposes of illustration only, wherein the figures use like reference numerals to identify like elements. One skilled in the art will readily recognize from the following discussion that alternative embodiments of the structures and methods illustrated in the figures can be employed without departing from the principles of the disclosed technology described herein.

DETAILED DESCRIPTION

Modular Tent Having Base Extensions

Tents are a popular and well-known way to provide campers (e.g., car campers, hikers/backpackers, mountaineers, hunters, military etc.) with temporary shelter and protection from the elements. Tents generally include a structural component, such as tent poles, and an enclosure supported by the structural component to protect users from the elements. It is generally desirable for a tent to be collapsible into a portable package so that the tent can be transported. Campers can purchase tents of varying sizes (e.g., maximum number of occupants), materials (e.g., engineered polymer fabrics, cotton canvas, mesh, aluminum, fiber glass, etc.), shapes (domed, hexagonal, elliptical, pyramid, and other geometric design combinations), and quality (e.g., summer, 3 seasons, 4 seasons, car camping, etc.) to suit their needs. Tents are often sold based on the number of people the tent can accommodate. For example, a customer can purchase a 1-person tent all the way up to a 12-person tent at common retail merchants. The total number of people that can be accommodated within a tent is largely dependent on the base surface area provided by the tent. For example, a tent having a base surface area of 40 sq. ft. may be able to comfortably accommodate two people while a tent having a base surface area of 100 sq. ft. may be able to comfortably accommodate five people.

In some instances, customers, particularly those who camp frequently, may feel the need to purchase multiple tents of different sizes in order to accommodate groups of varying sizes. This can result in customers being forced to spend large sums of money for camping equipment. Furthermore, customers may feel the need to purchase and store one or more tents in sizes that the customer may require for a particular trip, but may not need very frequently. For example, a frequent 4 person camper who seldom goes on camping trips with a larger group of 6 or more people may, nevertheless, be required to purchase a 6-person tent for those few occasions when he or she goes camping with a larger group or alternatively purchase another 2 person tent and split up the group into two tents.

Therefore, an improved approach can be beneficial for overcoming these and other disadvantages associated with conventional approaches. The disclosed technology provides a modular tent having removable base extensions that can vary the size of the modular tent. In some embodiments, a user can attach base extensions to an upper tent portion of the modular tent to increase the dimensions of the modular tent according to the needs of a particular trip. Similarly, the user can also detach base extensions from the upper tent portion of the modular tent to decrease the dimensions of the modular tent. In this way, a user can save on both storage space and cost by purchasing a single modular tent with various base extensions that can be used to adjust the size of the modular tent.

FIG. 1 illustrates a modular tent 100, including an upper tent portion 105 and a base extension 110. In various embodiments, the upper tent portion 105 does not have a floor surface, structure, or lining and is, therefore, left exposed to the ground on which it sits. When the upper tent portion 105 is deployed, the lower most edges of the upper tent portion 105 can define a base surface area. In some embodiments, the upper tent portion 105 can be paired with a floor (e.g., footprint) to be used as a tent. Alternatively, in some embodiments, the upper tent portion 105 can be used in conjunction with the base extension 110. The base extension 110 has a floor surface, structure, or lining 150 that prevents the bottom of the base extension 110 from being exposed to the ground on which the base extension 110 sits. In such embodiments, one or more dimensions of the modular tent 100, including the base surface area, and thus the size of the modular tent 100 can be increased by joining the base extension 110 to the upper tent portion 105. In some embodiments, the base extension 110 can be removed to allow for a second base extension to be secured to the upper portion of the tent 105. In such embodiments, the second base extension can have a base surface area that is greater than the base surface area of the base extension 110 as well as the base surface area of just the upper tent portion 105. Thus, by attaching the second base extension to the upper tent portion 105, the overall size and surface area of the modular tent 100 can be increased to adapt to the needs of its users.

The modular tent 100 is structurally supported by support poles 115. The support poles 115 are secured to the upper tent portion 105 and the base extension 110 using at least a plurality of straps 120. The upper tent portion 105 includes a door 125, which can be opened and closed using a door zip fastener 130. In the embodiment shown in FIG. 1, the door zip fastener 130 extends from the upper left hand corner of the door 125 to the bottom right hand corner. The base extension 110 is secured to the upper tent portion 105 by an extension zip fastener 135. In the embodiment shown in FIG. 1, the extension zip fastener 135 begins at a start point 140 proximate the bottom right hand corner of the door 125, and continues counter-clockwise around the modular tent 100 to an end point 145, just to the left of the start point 140. In such embodiments, the start point 140 and the end point 145 are proximate one another, but disconnected, such that there is a clear zip fastener start point and zip fastener end point. By arranging the door zip fastener 130 and the extension zip fastener 135 in this way, the door zip fastener 130 and the extension zip fastener 135 can work in tandem to open and close the door 125. To open the door 125, the door zip fastener 130 can be completely unzipped by moving the handle of the door zip fastener 130 from the bottom right hand corner of the door 125 to the upper left hand corner. The extension zip fastener 135 can be partially unzipped from the end point 145 to proximate the bottom left-hand corner of the door 125. When these two zip fasteners 130, 135 are unzipped in this manner, three of the four sides of the door 125 are unsecured, thereby permitting tent occupants to enter and leave the modular tent 100. Although the disclosed embodiment uses a single continuous zip fastener 135, more than one discrete independent piece can be used to connect the upper tent portion 105 to the base extension 110. For example, there may be a separate zip fastener used for each wall corner. Furthermore, although disclosed embodiments use zip fasteners to secure different components together, it will be appreciated by those of ordinary skill in the art that any appropriate fastener can be used, including zip fasteners, hook and loop fasteners, press-in fasteners, detachable sliders, buttons, Velcro, and the like.

It can be seen in FIG. 1 that the base extension 110 has a height H, a base length L, and a base width W. In FIG. 1, the base extension 110 is used to increase the base surface area of the modular tent 100. For example, the upper tent portion 105 alone may have a base surface area x. The base extension 110 may have a base surface area y, where y is greater than x. In this example, by attaching the upper tent portion 105 to the base extension 110, the base surface area for the modular tent 100 becomes y and, therefore, increases. By attaching base extensions of varying dimensions, the base surface area and thus the size of the modular tent 100 can be modified, and, therefore, the number of people that can be accommodated by the modular tent 100 can also be modified as needed to accommodate more or fewer individuals.

The modular tent 100 is provided as just one example design and any of the embodiments described herein may vary in a number of ways including, for example, design, size, geometric shape, etc. For example, the modular tent 100 can be domed, hexagonal, elliptical, pyramid, or any other geometric design. As another example, the base surface area defined by the upper tent portion and base surface area of the base extension can be rectangular, triangular, circular, etc.

Figure 2:
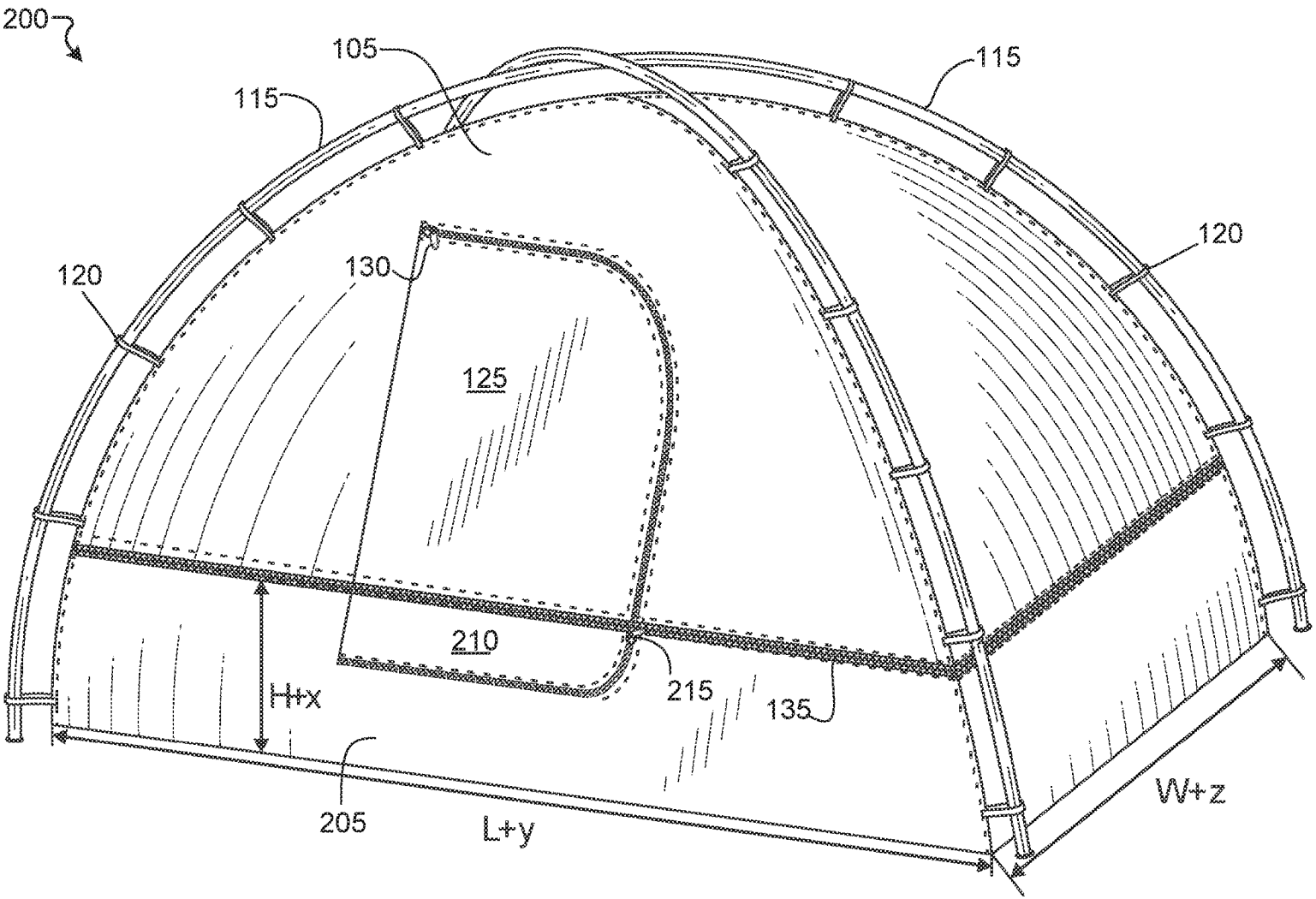
FIG. 2 provides a perspective view of a modular tent having a second, larger base extension, according to an embodiment of the present disclosure.

FIG. 2 illustrates a modular tent 200 having the same upper tent portion 105 as FIG. 1, but with a larger base extension 205 zip-fastened to the upper tent portion 105. As shown in FIG. 2, the larger base extension 205 has a height H+x, a base length L+y, and a base width W+z, where the size of each x, y, and z increases the respective height H, base length L, and base width W. By replacing the base extension 110 of FIG. 1 with the larger base extension 205 of FIG. 2, a user can increase the dimensions of the modular tent 200, including the base surface area and thus the size of the modular tent 200, so that the modular tent 200 can accommodate more people and/or storage.

It may be the case that the support poles 115 will also have to be adjusted based on the varying size of the modular tent 200. For example, a larger tent may require larger support poles. This may be addressed in a variety of ways. In some embodiments, users may purchase support poles of varying lengths to be used in conjunction with base extensions of varying sizes. In some embodiments, the support poles 115 may be extendable support poles or modular support poles so that the size of the support poles 115 can be adjusted according to the size of the modular tent. In some embodiments, the straps 120 used to secure the support poles 115 to the upper tent portion 105 and the base extension 205 can be variable in size or length. For example, support poles that are long enough to support a relatively large modular tent can be used to support a smaller modular tent by increasing the length of the straps 120. In certain embodiments, rather than using straps 120, the support poles 115 may be secured using sleeves. In this case, rather than adjusting the length of the straps 120, the dimensions of the sleeves may be adjusted to accommodate modular tents and base extensions of varying dimensions.

The use of an outer cover, or a rainfly, to cover the outside of a tent is common. A rainfly used in conjunction with the modular tents 100, 200 disclosed herein can also include extensions to adjust the dimensions of the rainfly based on the dimensions of the modular tent and/or the base extension. For example, a rainfly can be provided that is large enough to cover the smaller modular tent 100, and rainfly extensions can be secured to the rainfly to increase the dimensions of the rainfly to cover the larger modular tent 200. Alternatively, a full rainfly for the smaller modular tent 100 can also be used as a partial rainfly for the larger modular tent 200. Alternatively, a partial rainfly adequate to cover the upper tent portion 105 can be used as a partial rainfly for both the modular tents 100 and 200. Rainfly extensions can be secured to the base rainfly using any appropriate fastener, including zip fasteners, hook and loop fasteners, press-in fasteners, detachable sliders, and the like. Other common knowledge features of securing a rainfly to a tent, poles and the ground should be understood to be part of the rainfly designed for the modular tents disclosed herein.

The base extension 205 shown in FIG. 2 includes a door extension 210. The door extension 210 allows for a user to increase the height of the modular tent without increasing the height of the entryway. The door extension 210 is opened and closed using a separate door extension zip fastener 215. In the embodiment shown in FIG. 2, the door extension fastener 215 is opened from the top right corner of the door extension to the bottom left corner, and closed from the bottom left corner to the top right corner of the door extension. Operation of the door 125 and the door extension 210 are discussed in greater detail herein, particularly with reference to FIGS. 6 and 7.

Figure 3:
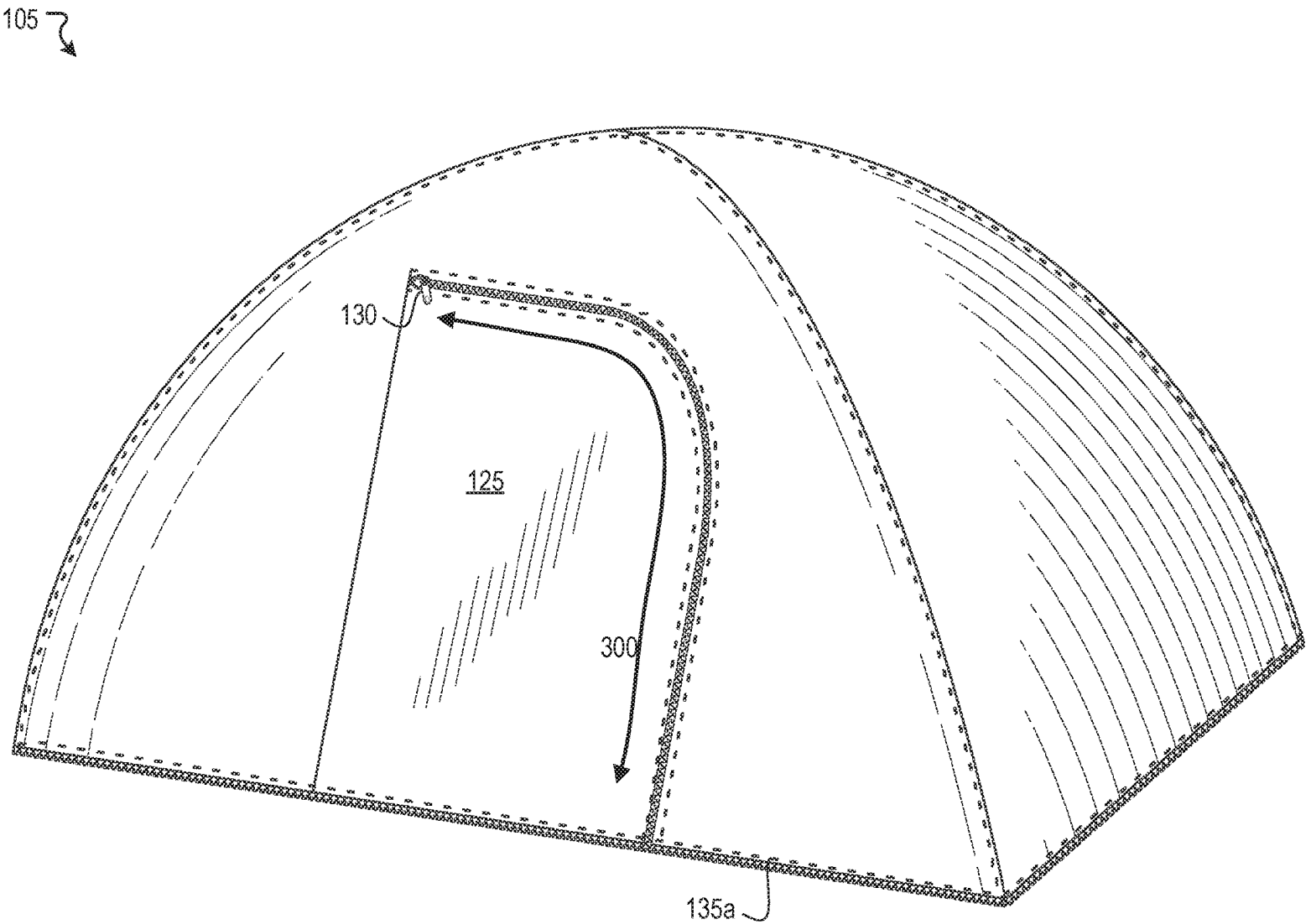
FIG. 3 provides a perspective view of an upper tent portion of a modular tent, according to an embodiment of the present disclosure.

FIG. 3 provides a perspective view of the upper tent portion 105. As discussed above, the upper tent portion 105 includes a door 125, that can be opened and closed using a door zip fastener 130. As shown by an arrow 300, the door zip fastener 130 is movable between the top left hand corner of the door 125, and the bottom right hand corner. In the embodiment shown in FIG. 3, the door 125 is opened by sliding a handle of the door zip fastener 130 from the bottom right hand corner to the top left hand corner. Similarly, the door 125 is secured closed by sliding the handle of the door zip fastener 130 in the opposite direction from the top left hand corner to the bottom right hand corner. The upper tent portion 105 can be secured to a base extension by securing an upper portion of the extension zip fastener 135*a* to a corresponding lower portion of the extension zip fastener on the base extension. In various embodiments, the upper tent portion 105 is open at its based and does not have a floor surface.

Figure 4:
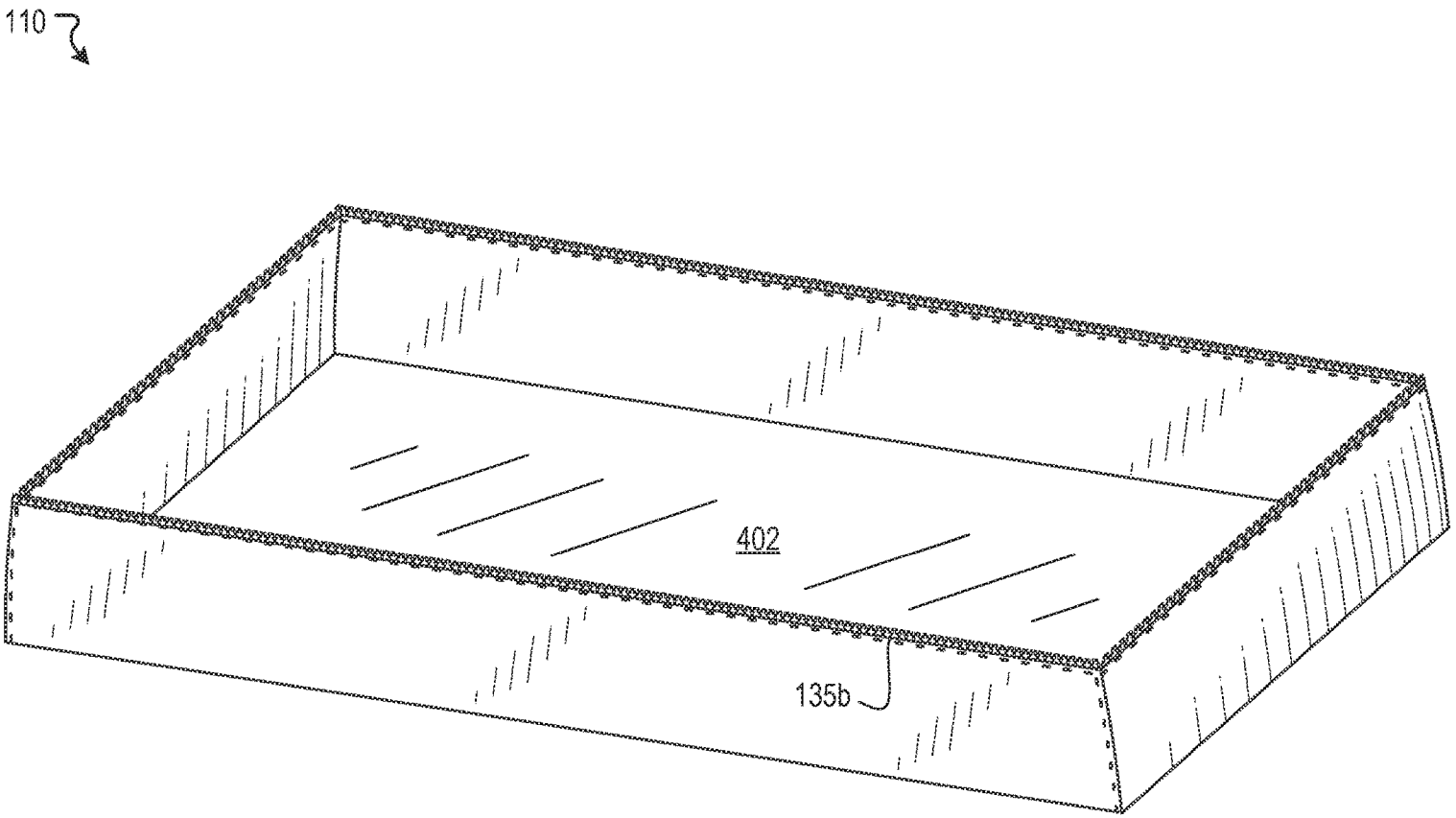
FIG. 4 provides a perspective view of a first base extension, according to an embodiment of the present disclosure.

FIG. 4 provides a perspective view of a base extension 110, including the lower portion of the extension zip fastener 135*b*. In various embodiments, the base extension 110 includes a floor surface 402 to provide a floor surface for the modular tent 100.

Figure 5:
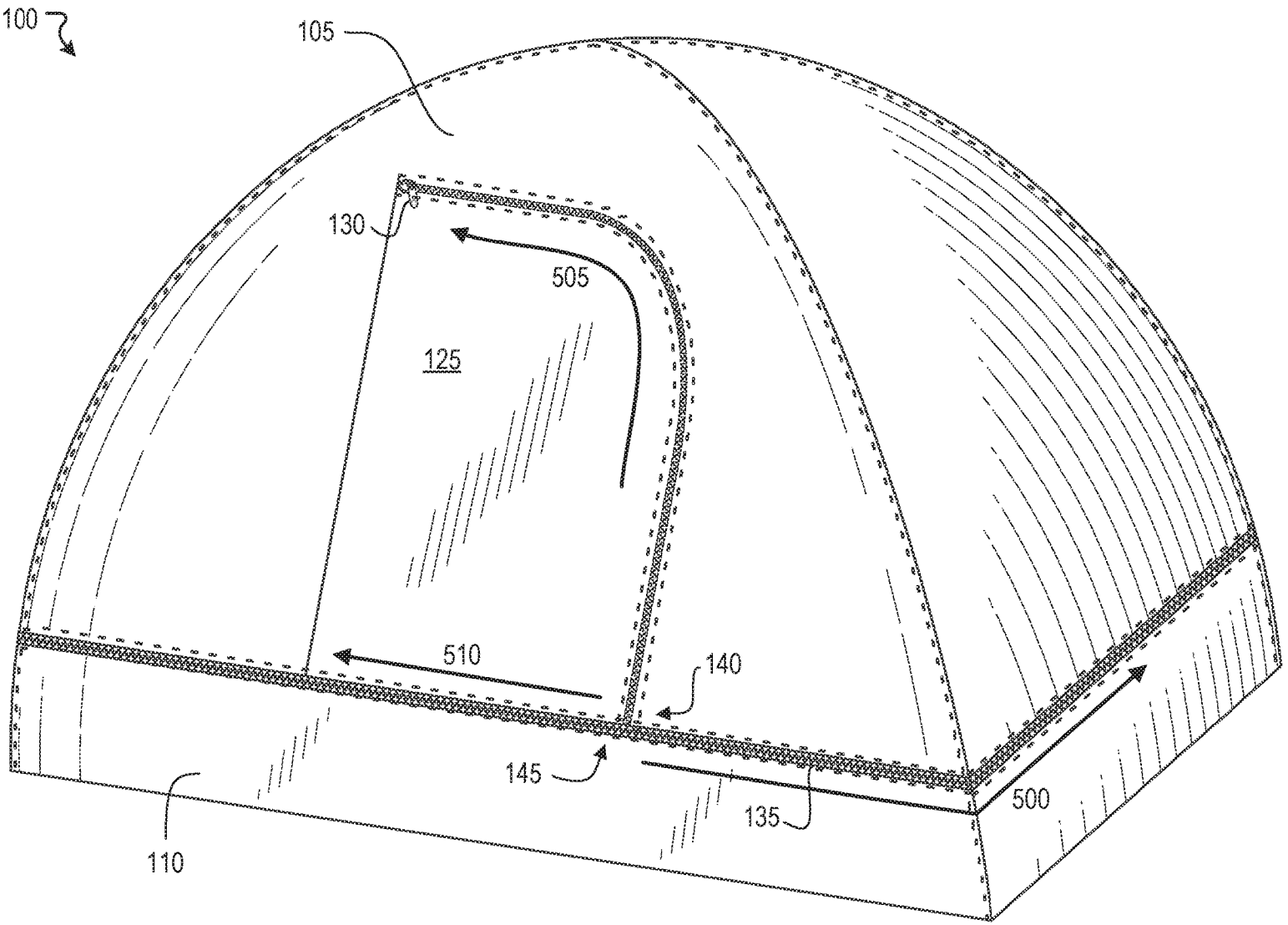
FIG. 5 provides a perspective view of a modular tent incorporating the upper tent portion of FIG. 3 and the first base extension of FIG. 4, according to an embodiment of the present disclosure.

FIG. 5 provides a perspective view of the upper tent portion 105 secured to the base extension 110 via the extension zip fastener 135. As discussed above, the upper tent portion 105 can be secured to the base extension 110 by securing the upper portion of the extension zip fastener 135*a* to the lower portion of the extension zip fastener 135*b* at a start point 140. The extension zip fastener 135 is closed by moving a handle of the zip fastener 135 counter-clockwise around the modular tent 100 (arrow 500) until it reaches an end point 145, located just to the left of the start point 140. The door 125 can be opened by unzipping the door zip fastener 130 from the bottom right corner of the door to the top left corner arrow 505, and unzipping the extension zip fastener 135 from the end point 145 to proximate the bottom left corner of the door 125 (arrow 510). The configuration of the start point 140 and the end point 145 is provided as one example and, naturally, other approaches, start points, and end points may be used to secure the upper tent portion 105 and the base extension 110.

Figure 6:
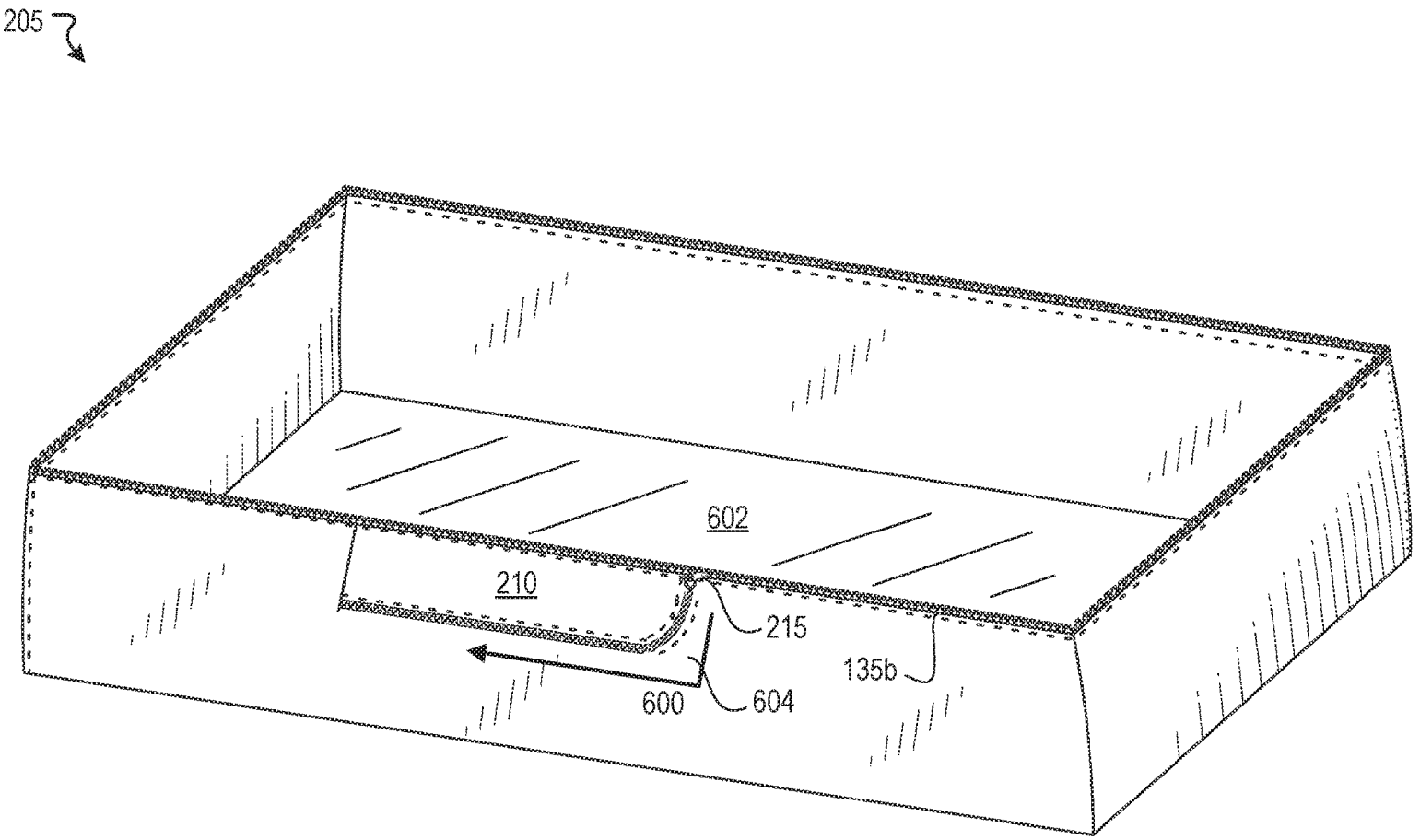
FIG. 6 provides a perspective view of a second base extension having a door extension, according to an embodiment of the present disclosure.

FIG. 6 illustrates a perspective view of a larger base extension 205, which includes a door extension 210 and a door extension zip fastener 215. The door extension zip fastener 215 can be secured, or closed, by sliding a handle of the door extension zip fastener 215 from the bottom left hand corner of the door extension 210 to the top right corner of the door extension 210. The door extension 210 can be opened by sliding the door extension zip fastener 215 in the opposite direction, as illustrated by the arrow 600. As mentioned, in some embodiments, the removable base extension 205 has a floor surface, structure, or lining 602 that prevents the bottom of the base extension 205 from being exposed to the ground and provides a floor surface for the modular tent 200. As shown in FIG. 6, the door extension zip fastener 215 is configured to fasten the door extension 210 by sliding a handle of the door extension zip fastener 215 along a curve 604. However, the zipper configuration may differ depending on the implementation. For example, in some embodiments, zipper may be configured so that the door extension zip fastener 215 fastens the door extension 210 along a right angle instead of a curve 604.

Figure 7:
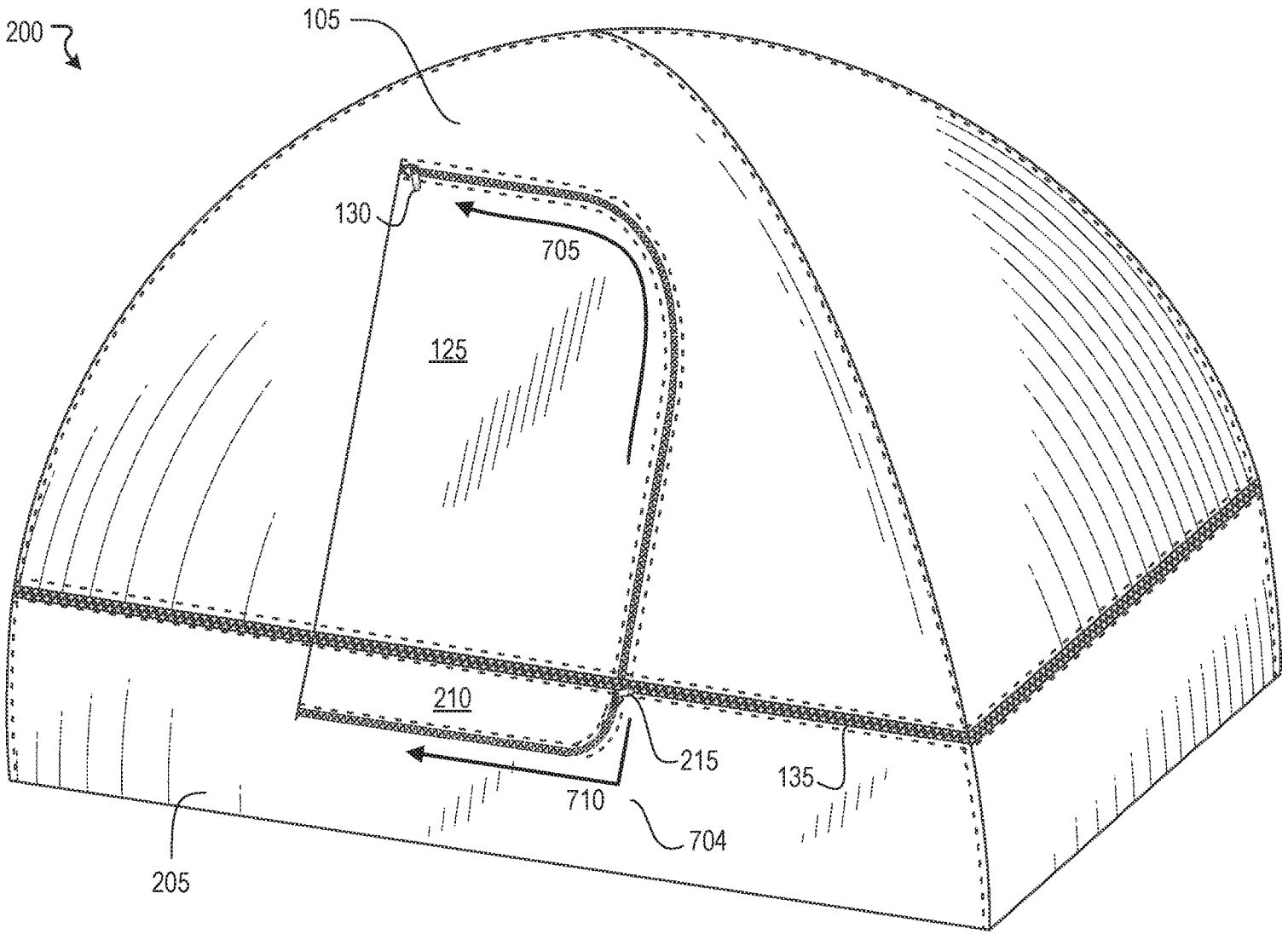
FIG. 7 provides a perspective view of a modular tent incorporating the upper tent portion of FIG. 3 and the second base extension of FIG. 6, according to an embodiment of the present disclosure.

FIG. 7 illustrates a perspective view of a modular tent 200 in which the upper tent portion 105 has been secured to the larger base extension 205. The operation of the door 125 can be similar to that described with regard to FIG. 5. For example, the door can be opened by unzipping the door zip fastener 130 along a direction indicated by the arrow 705. However, in this case, the extension zip fastener 135 does not need to be undone to allow ingress and egress from the modular tent 200. Instead, the door extension 210 can be opened by unzipping the door extension zip fastener 215 along a direction indicated by the arrow 710. When the door zip fastener 130 and the door extension zip fastener 215 are unzipped in this way, the door 125 and the door extension 210 can open as a single, connected piece to create an entryway (e.g., opening) having a lower entryway height. In some embodiments, the height of the door extension 210 can be such that an entryway height, defined as the distance from the bottom of the base extension 205 to the bottom of the door extension 210, satisfies a maximum entryway height threshold, or satisfies a uniform entryway height. For example, if a uniform entryway height is set at 4-inches, then a base extension having a height of 4-inches would not require a door extension, a base extension having a height of 6-inches would require a 2-inch door extension, and a base extension having a height of 10-inches would require a 6-inch door extension, and so forth. As shown in FIG. 7, the door extension zip fastener 215 is configured to fasten the door extension 210 by sliding a handle of the door extension zip fastener 215 along a curve 704. However, the zipper configuration may differ depending on the implementation. For example, in some embodiments, zipper may be configured so that the door extension zip fastener 215 fastens the door extension 210 along a right angle instead of a curve 704.

Although the embodiments discussed above have discussed a single base extension being secured to an upper tent portion, it should be appreciated that a modular tent with variable dimensions could also be achieved by securing multiple extensions to one another, and securing those multiple extensions to the upper tent portion. In other embodiments, various components of varying sizes other than the base extensions may also be removable and replaceable. For example, doors of varying sizes may be available and can be matched with different upper tent portions and different combinations of base extensions.

Figure 8:
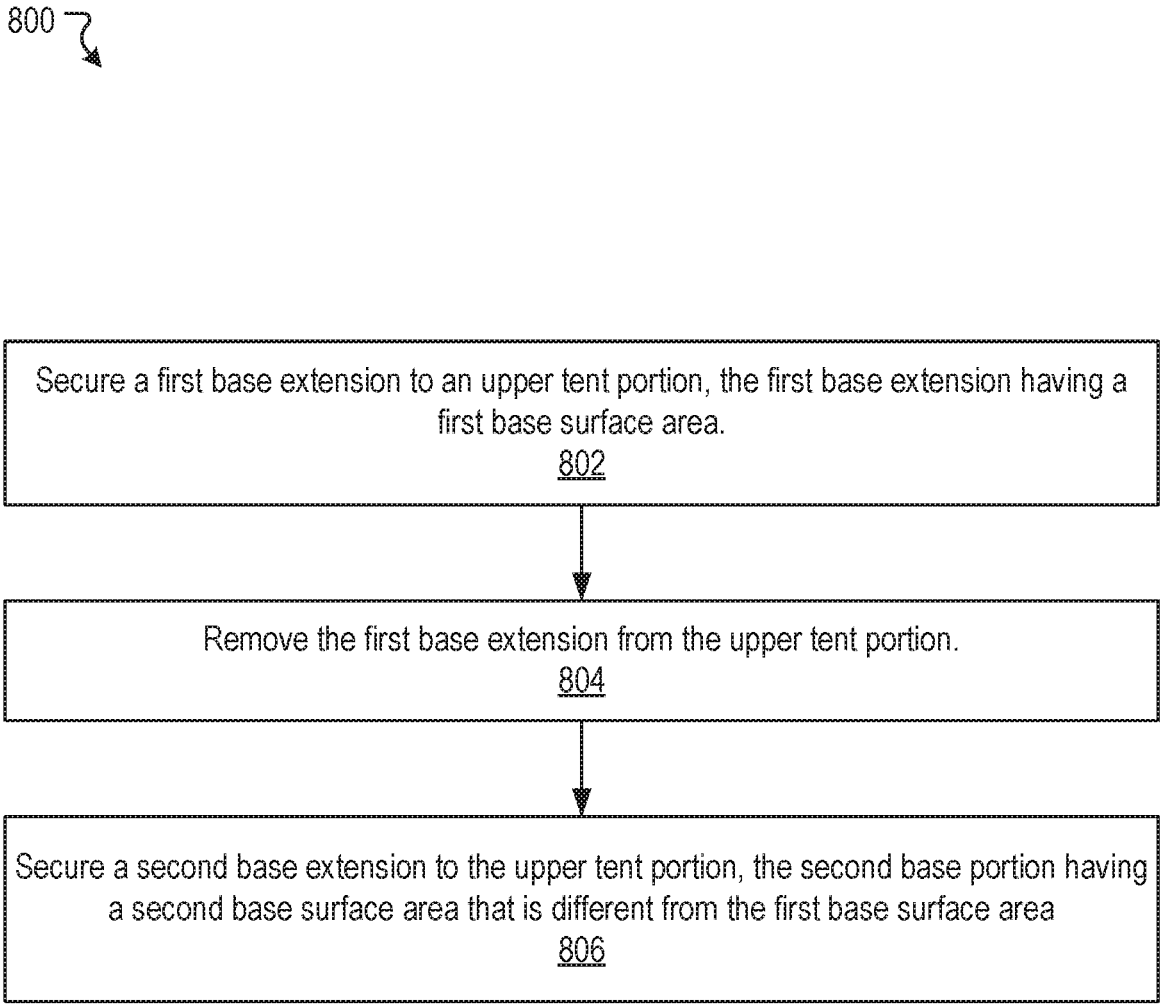
FIG. 8 illustrates an example method associated with assembling a modular tent, according to an embodiment of the present disclosure.

FIG. 8 illustrates an example method 800 associated with operating a modular tent, according to an embodiment of the present disclosure. It should be appreciated that there can be additional, fewer, or alternative steps performed in similar or alternative orders, or in parallel, based on the various features and embodiments discussed herein unless otherwise stated.

At block 802, the example method 800 can secure a first base extension to an upper tent portion, the first base extension having a first base surface area. At block 804, the example method 800 can remove the first base extension from the upper tent portion. At block 806, the example method 800 can secure a second base extension to the upper tent portion, the second base extension having a second base surface area that is different from the first base surface area.

For purposes of explanation, numerous specific details are set forth in order to provide a thorough understanding of the description. It will be apparent, however, to one skilled in the art that embodiments of the disclosure can be practiced without these specific details. In some instances, modules, structures, processes, features, and devices are shown in block diagram form in order to avoid obscuring the description. In other instances, functional block diagrams and flow diagrams are shown to represent data and logic flows. The components of block diagrams and flow diagrams (e.g., modules, blocks, structures, devices, features, etc.) may be variously combined, separated, removed, reordered, and replaced in a manner other than as expressly described and depicted herein.

Reference in this specification to "one embodiment", "an embodiment", "other embodiments", "one series of embodiments", "some embodiments", "various embodiments", "certain embodiments", or the like means that a particular feature, design, structure, or characteristic described in connection with the embodiment is included in at least one embodiment of the disclosure. The appearances of, for example, the phrase "in one embodiment" or "in an embodiment" in various places in the specification are not necessarily all referring to the same embodiment, nor are separate or alternative embodiments mutually exclusive of other embodiments. Moreover, whether or not there is express reference to an "embodiment" or the like, various features are described, which may be variously combined and included in some embodiments, but also variously omitted in other embodiments. Similarly, various features are described that may be preferences or requirements for some embodiments, but not other embodiments.

The language used herein has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A modular tent comprising:

an upper tent portion defining a first base surface area, the upper tent portion is capable of being attached to a plurality of candidate base extensions, wherein the upper tent portion includes a door that is openable and closable using a fastener; and a given base extension included among the candidate base extensions, the base extension having a floor surface defining a second base surface area, the second base surface area being greater than the first base surface area, wherein the base extension includes a door extension that is openable and closable using a different fastener, wherein the base extension, when attached to the upper tent portion, results in a base surface area of the modular tent increasing from the first base surface area to the second base surface area.

2. The modular tent of claim 1, wherein the modular tent is supported using a set of support poles, and wherein the support poles are sized to accommodate the upper tent portion and the base extension.

3. The modular tent of claim 1, wherein the base extension is removably attached to the upper tent portion using at least one of: a zip fastener, a hook and loop fastener, a press-in fastener, or a detachable slider.

4. The modular tent of claim 1, further comprising:

a different base extension included among the candidate base extensions, the different base extension having a floor surface defining a third base surface area, the third base surface area being greater than the first base surface area and the second base surface area.

5. The modular tent of claim 4, wherein the different base extension, when attached to the upper tent portion, results in the base surface area of the modular tent increasing from the first base surface area to the third base surface area.

6. An apparatus comprising:

a base extension that includes a floor surface, the base extension is capable of being removably secured to an upper tent portion to increase a base surface area defined by the upper tent portion, wherein the upper tent portion does not include a floor surface, wherein the upper tent portion includes a door that is openable and closable using a fastener, and wherein the base extension includes a door extension that is openable and closable using a different fastener; and at least one fastener for securing the base extension to the upper tent portion.

7. The apparatus of claim 6, wherein the door extension is configured to be removably secured to a door on the upper tent portion.

8. The apparatus of claim 6, wherein the at least one fastener comprises at least one of: a zip fastener, a hook and loop fastener, a press-in fastener, or a detachable slider.

9. A method comprising:

deploying a modular tent including an upper tent portion, the upper tent portion having an existing base surface area, wherein the upper tent portion includes a door that is openable and closable using a fastener; and attaching a removable first base extension to the upper tent portion, the first base extension being included among a plurality of candidate base extensions that are capable of being attached to the upper tent portion, wherein the first base extension has a first base surface area, wherein the removable first base extension includes a door extension that is openable and closable using a different fastener, wherein the first base surface area of the first base extension is greater than the existing base surface area of the upper tent portion.

10. The method of claim 9, wherein the existing base surface area accommodates a first number of occupants to be housed in the modular tent, and wherein the first base surface area accommodates a second number of occupants to be housed in the modular tent.

11. The method of claim 10, wherein the first base surface area accommodates a greater number of occupants than the existing base surface area.

12. The method of claim 9, the method further comprising:

removing the removable first base extension from the upper portion of the modular tent; and attaching a removable second base extension to the upper tent portion, the second base extension being included among the plurality of candidate base extensions that are capable of being attached to the upper tent portion, wherein the second base extension has a second base surface area that is greater than the first base surface area.

13. The method of claim 12, wherein the second base extension accommodates a greater number of occupants to be housed in the modular tent than the first base extension.

* * * * *